US009140091B1

(12) United States Patent
Cox

(10) Patent No.: US 9,140,091 B1
(45) Date of Patent: Sep. 22, 2015

(54) APPARATUS AND METHOD FOR ADJUSTING AN ANGULAR ORIENTATION OF A SUBSEA STRUCTURE

(71) Applicant: Brent Cox, Houston, TX (US)

(72) Inventor: Brent Cox, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 99 days.

(21) Appl. No.: 14/067,375

(22) Filed: Oct. 30, 2013

(51) Int. Cl.
*E21B 7/12* (2006.01)
*E21B 33/038* (2006.01)

(52) U.S. Cl.
CPC ..... *E21B 33/038* (2013.01)

(58) Field of Classification Search
CPC ..... E21B 43/0122
USPC ..... 414/650, 137.1; 166/341–343, 363
See application file for complete search history.

(56) References Cited

U.S. PATENT DOCUMENTS 3,913,669 A * 10/1975 Brun et al. ..... 166/349
4,023,619 A * 5/1977 Marquaire et al. ..... 166/341
4,153,112 A * 5/1979 Luke ..... 166/355
4,202,427 A * 5/1980 Sada et al. ..... 182/2.1
4,324,505 A 4/1982 Hammett
4,405,258 A 9/1983 O'Rourke et al.
4,604,961 A * 8/1986 Ortloff et al. ..... 114/230.12
4,665,856 A * 5/1987 Pedersen ..... 114/230.14
4,721,415 A * 1/1988 Shatto ..... 405/224.1
4,828,024 A 5/1989 Roche
4,830,541 A * 5/1989 Shatto ..... 405/226
4,919,393 A * 4/1990 Calkins ..... 254/337
5,771,974 A * 6/1998 Stewart et al. ..... 166/336
5,890,841 A * 4/1999 Friis et al. ..... 405/170
5,984,012 A 11/1999 Wactor et al.
6,026,905 A * 2/2000 Garcia-Soule ..... 166/336
6,035,938 A * 3/2000 Watkins ..... 166/345
6,070,668 A * 6/2000 Parks et al. ..... 166/345
6,161,769 A * 12/2000 Kircher et al. ..... 239/2.2
6,227,300 B1 * 5/2001 Cunningham et al. ..... 166/339
6,336,508 B1 * 1/2002 Guinn ..... 166/339
6,352,114 B1 * 3/2002 Toalson et al. ..... 166/343
6,408,949 B1 * 6/2002 Aquilera et al. ..... 166/368
6,470,973 B1 * 10/2002 Rangnes et al. ..... 175/7
7,140,319 B2 * 11/2006 Raines ..... 114/296
7,165,619 B2 1/2007 Fox et al.
7,527,455 B2 * 5/2009 Raines ..... 405/228
7,585,179 B2 * 9/2009 Roberts ..... 439/451
7,597,811 B2 10/2009 Usher
7,645,093 B1 * 1/2010 Clark et al. ..... 405/173
7,921,917 B2 4/2011 Kotrla et al.
8,056,492 B2 * 11/2011 Roodenburg et al. ..... 114/268
8,356,674 B2 * 1/2013 Murray et al. ..... 166/380
8,381,818 B2 * 2/2013 Adams et al. ..... 166/338
8,475,081 B2 * 7/2013 Clark et al. ..... 405/156
8,499,838 B2 * 8/2013 Fraser et al. ..... 166/338

(Continued)

*Primary Examiner* — Matthew Buck
*Assistant Examiner* — Aaron Lembo
(74) *Attorney, Agent, or Firm* — Egbert Law Offices, PLLC

(57) ABSTRACT

An apparatus for causing an indication of a connector of a subsea structure has a lifting structure pivotally affixed adjacent an upper end of the subsea structure, an extension extending outwardly adjacent a bottom of the subsea structure and an inclination tool cooperative with the extension so as to move the lower end of the subsea structure in an angular direction offset from horizontal. The inclination tool has a ratchet mechanism cooperative with a line extending from the lifting structure. Hydraulic actuators serve to draw the ratchet mechanism upwardly in a direction toward the lifting structure.

18 Claims, 3 Drawing Sheets

(56) References Cited

U.S. PATENT DOCUMENTS

| | | | | |
|---|---|---|---|---|
| 8,561,565 | B2 * | 10/2013 | Zimmerman | 114/301 |
| 8,696,245 | B2 * | 4/2014 | Clark et al. | 405/156 |
| 8,783,478 | B2 * | 7/2014 | Roodenburg | 212/309 |
| 2009/0095464 | A1 | 4/2009 | McGrath et al. | |
| 2009/0260829 | A1 | 10/2009 | Mathis | |
| 2011/0097156 | A1 * | 4/2011 | Pose | 405/166 |
| 2012/0267116 | A1 * | 10/2012 | Anderson | 166/340 |
| 2012/0292037 | A1 * | 11/2012 | Gutierrez et al. | 166/341 |
| 2012/0318520 | A1 | 12/2012 | Lugo | |
| 2012/0318521 | A1 * | 12/2012 | Franklin et al. | 166/363 |
| 2012/0318522 | A1 * | 12/2012 | Franklin et al. | 166/363 |
| 2012/0324876 | A1 * | 12/2012 | Fuselier et al. | 60/327 |
| 2013/0175048 | A1 * | 7/2013 | Goode et al. | 166/379 |
| 2013/0206419 | A1 * | 8/2013 | Hallundbaek et al. | 166/341 |
| 2013/0341088 | A1 * | 12/2013 | Gleadowe et al. | 175/5 |
| 2014/0090856 | A1 * | 4/2014 | Pratt et al. | 166/380 |
| 2015/0063917 | A1 * | 3/2015 | Feijen et al. | 405/166 |

* cited by examiner

APPARATUS AND METHOD FOR ADJUSTING AN ANGULAR ORIENTATION OF A SUBSEA STRUCTURE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to subsea structures, such as wellheads, blowout preventers and capping stacks. More particularly, the present invention relates to mechanisms for adjusting an angular orientation of the subsea structure such that the subsea structure can be mounted upon an angularly offset connector of a blowout preventer or a wellhead. More particularly, the present invention the relates to inclination tools for the subsea adjustment of the angular orientation of the subsea structure.

2. Description of Related Art Including Information Disclosed Under 37 CFR 1.97 and 37 CFR 1.98.

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to amarine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disburse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Patent Publication No. 2012/0318520, published on Dec. 20, 2012 to M. R. Lugo, describes a diverter system for a subsea well in which there is a blowout preventer and a diverter affixed to an outlet of the blowout preventer. The blowout preventer will have an interior passageway with an inlet at a bottom thereof and an outlet at a top thereof. The diverter has a flow passageway extending therethrough and communication with the interior passageway of the blowout preventer. The diverter has a valve therein for changing a flow rate of a fluid flowing through the flow passageway. The diverter has at least one channel opening in valved relation to the flow passageway so as to allow the fluid from the flow passageway to pass outwardly of the diverter. At least one flow line is in valved communication with the flow passageway so as to allow fluids or materials to be introduced into the flow passageway.

The diverter system of U.S. Patent Publication No. 2012/0318520 is known as a "capping stack". This product is manufactured and sold by Trendsetter Engineering, Inc. of Houston, Tex. Experience with the capping stack has shown that there are instances where the capping stack can be easily installed by virtue of the fact that the connector of the blowout preventer or the wellhead lies entirely in a horizontal or near horizontal plane. As such, the capping stack can be lowered and directly mounted upon the mating surface of the connector of the blowout preventer or the wellhead.

Unfortunately, under many circumstances, a blowout preventer or the wellhead has experienced a certain amount of damage as result of a subsea episode. As such, the forces created from the subsea episode can cause the wellhead or the connector of the blowout preventer to be angularly offset from horizontal. Under such circumstances, especially when the plane of the connector of the blowout preventer is more than 4° offset from horizontal, it becomes increasingly difficult to install the connector of the capping stack onto the connector of the blowout preventer. As such, a need has developed in which to be able to angularly incline the plane of the connector of the capping stack so as to properly mate with the flange or mandrel of the wellhead or blowout preventer. This avoids the need for complex underwater operation in order to achieve the necessary connection.

It is an object of the present invention to provide an apparatus and process for the inclination of a subsea structure which allows the mating surface of the subsea structure to properly mate with and angularly inclined surface of a wellhead or a blowout preventer.

It is another object of the present invention to provide an apparatus and process for inclining a subsea structure which avoids the end for complex underwater subsea procedures.

It is a further object of the present invention to provide an apparatus and process for inclining a subsea structure that can be adaptable to a wide range of angular inclinations.

It is still another object of the present invention to provide an apparatus and process for the inclining of a subsea structure which can be easily manipulated subsea through the use of a remotely-operated vehicle (ROV).

It is another object of the present invention to provide an apparatus and process for the inclination of a subsea structure which is easy to use, relatively inexpensive and easy to manufacture.

These and other objects and advantages of the present invention will become apparent from a reading of the attached specification and appended claims.

BRIEF SUMMARY OF THE INVENTION

The present invention is an apparatus for the inclination of a subsea structure in which the subsea structure has an upper end and a lower end. A lifting structure is affixed adjacent to the upper end of the subsea structure and extends upwardly therefrom. A first extension extends outwardly adjacent to the lower end of the subsea structure. An inclining mechanism serves to move the first extension and the lower end of the subsea structure in angular direction offset from horizontal. The subsea structure is in the nature of a capping stack. The lower end of the subsea structure has a bottom with a connector suitable for attachment to a blowout preventer or to a wellhead.

The lifting structure includes a spreader bar having a lower end pivotally affixed to the upper end of the subsea structure and a cable affixed to the spreader bar and extending upwardly therefrom. The spreader bar has a second extension extending outwardly therefrom in a direction corresponding to a direction that the first extension extends outwardly from the lower end subsea structure. The first extension is a first arm that extends outwardly of the subsea structure. The second extension is a second arm that extends outwardly of the spreader bar.

The inclining mechanism includes a line having one end affixed to the second arm and extending outwardly and downwardly therefrom, and an inclination tool having one end connected or interconnected to the first arm. The inclination tool has an opposite end affixed to and cooperative with the line. The inclination tool includes a body that has a first connector at one end thereof connected to the line and a second connector at an opposite end thereof connected to the lower end of the subsea structure. The body includes a main cylinder having an interior. The main cylinder is connected to or interconnected to the lower end of the subsea structure. A ratchet rod is slidably received in the main cylinder. The ratchet rod has a teeth formed thereon. A ratchet rod can be connected to the line. A ratchet lock mechanism is cooperative with the teeth of the ratchet rod so as to selectively allow the ratchet rod to slide in the main cylinder. A hydraulic actuator is affixed to the main body. A yoke is affixed to the ratchet rod and to the hydraulic actuator. The yoke is connected to the line. The hydraulic actuator is suitable for moving the yoke toward or away from the main body. A controller is affixed to the main body. The controller is cooperative with the ratchet lock mechanism so as to allow one of a free movement of the ratchet rod in the main cylinder and a ratcheting movement of the ratchet rod in the main cylinder and a locked position in which the ratchet rod is fixed in relation to the main cylinder.

The present invention is also an inclination tool for adjusting an angular orientation of a subsea structure. The inclination tool includes a body having a main cylinder with one end suitable for connection to the subsea structure, a yoke suitable for connection to a lifting mechanism of the subsea structure, a ratchet rod extending into the main cylinder and having teeth formed thereon, a ratchet lock mechanism affixed to the main body and selectively engageable with the teeth and the ratchet rod so as to fix a position of the ratchet rod in the main cylinder, and a hydraulic actuator affixed to the main body and to the yoke so as to move the yoke relative to the body. The ratchet rod has an end affixed to the yoke.

In the inclination tool of the present invention, the hydraulic actuator includes a first hydraulic actuator positioned in parallel relation to and on one side of the main cylinder, and a second hydraulic actuator positioned in parallel relationship to and an opposite side of the main cylinder. A controller is affixed to the main body and cooperative with the ratchet lock mechanism. The controller allows one of a free movement of the ratchet rod in the main cylinder and a ratcheting movement of the ratchet rod in the main cylinder and a locked position in which the ratchet rod is fixed in relation to the main cylinder. A hot stab is affixed to the main body and cooperative with the hydraulic actuator. The hot stab is suitable for allowing an ROV to selectively control a movement of the hydraulic actuator.

The present invention is also a process for causing an subsea inclination of a subsea structure. The process comprises the steps of: (1) affixing a lifting mechanism in pivotal relationship to the upper end of the subsea structure; (2) affixing a line to the lifting mechanism such that the line extends angularly outwardly and downwardly from the lifting mechanism; (3) attaching an inclination tool adjacent the lower end of the subsea structure such that the inclination tool is cooperative with the line; and (4) applying a force by the inclination tool to the line so as to cause the upper end of the subsea structure to pivot in relative to the lifting mechanism and to cause a bottom of the subsea structure to because angularly offset from horizontal.

The inclination tool has a yoke affixed to the line. The inclination tool has a body with a main cylinder therein. The yoke is affixed to a ratchet rod received in the main cylinder. The process further includes ratcheting the ratchet rod within the main cylinder so as to fix a distance between the yoke and the body, and locking the ratchet rod in a fixed position in relation to the main body so as to fix an angular orientation of the bottom of the subsea structure. The inclination tool also has a hydraulic actuator extending between the yoke and the main body. The process further includes actuating the hydraulic actuator so as to the draw the yoke toward the main body, and ratcheting the ratchet rod in relation to the main cylinder as the yoke is drawn toward the body. The bottom of the subsea structure can be connected to either the connector of a blowout preventer or a wellhead after the bottom is set in a desired angular orientation offset from horizontal. The line is released from the lifting mechanism and the inclination tool is released from the lower end of the subsea structure after the bottom of the subsea structure is connected to the blowout preventer or the wellhead.

This foregoing Section is intended to describe, with particularity, the preferred embodiments of the present invention. It is understood that modifications to these preferred embodiments can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
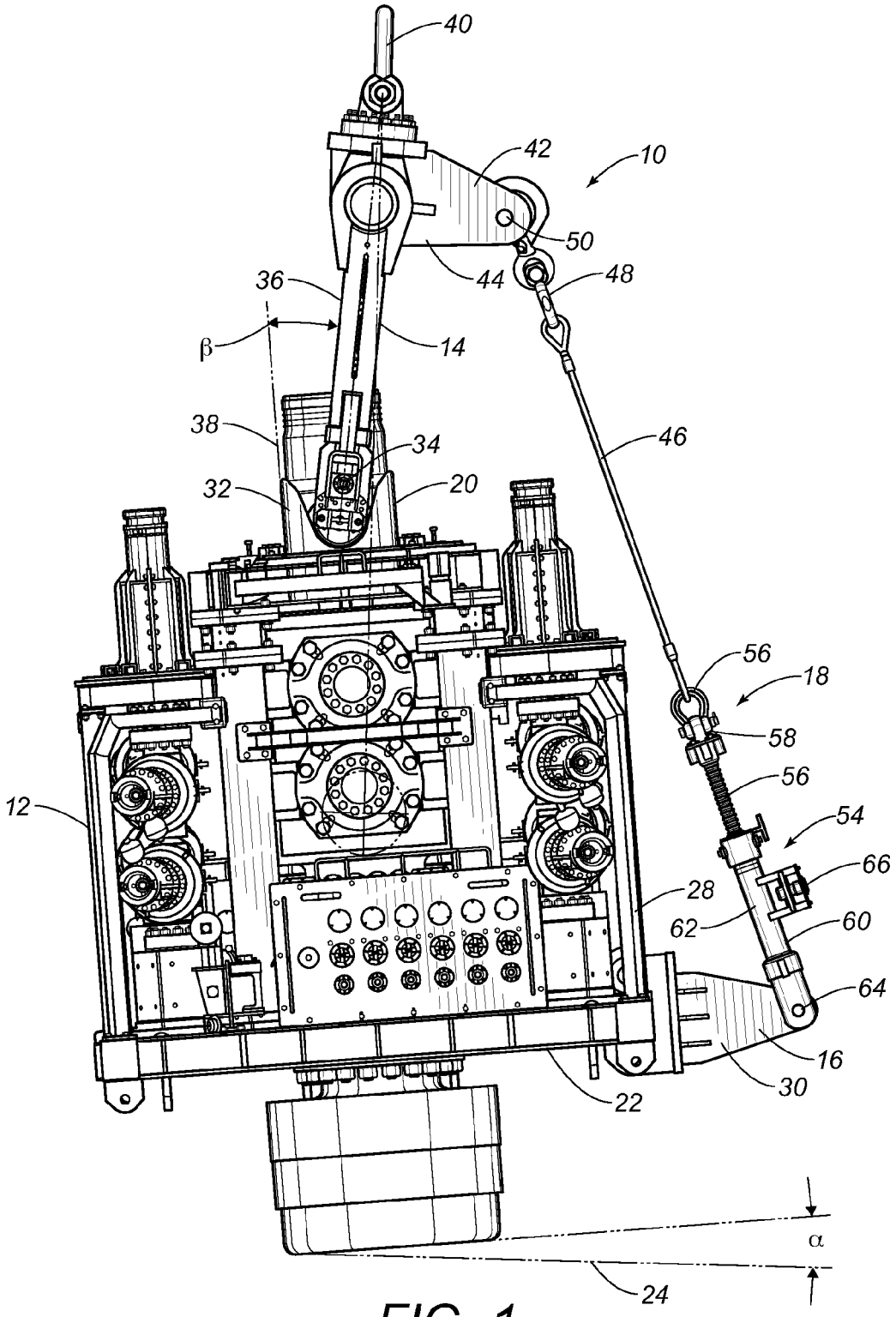
FIG. 1 is a side elevational view showing the inclination apparatus of the preferred embodiment of the present invention.

Referring to FIG. 1, there is shown the inclination apparatus 10 in accordance with the preferred embodiment of the present invention. The inclination apparatus 10 includes a subsea structure 12, a lifting mechanism 14, a first extension 16, and an inclining mechanism 18. The subsea structure 12 has an upper end 20 and a lower end 22. The subsea structure 12, as illustrated in FIG. 1, is in the nature of a capping stack that is manufactured and sold by Trendsetter Engineering, Inc. of Houston, Tex. The lifting structure 14 is pivotally mounted to the upper end 20 of the subsea structure 12. The first extension 16 extends outwardly adjacent to the lower end 22 of the subsea structure 12. The inclining mechanism 18 serves to move the first extension 16 and the lower end 22 of the subsea structure 12 in an angular direction (shown by angle $\alpha$) offset from horizontal 24. As such, the bottom 26 can be in a suitable angular orientation for connection to a connector of a blowout preventer or to a wellhead.

In FIG. 1, it can be seen that the subsea structure 12 includes a frame 28 that serves to secure all of the flow passageways associated with the subsea structure 12. The first extension 16 is in the nature of an arm 30 that is affixed to the frame 28 and extends outwardly therefrom. In particular, the arm 30 is a plate that is rigidly affixed to the frame 28 and extends outwardly from the subsea structure 12 for a suitable distance. The subsea structure 12 includes a guide area 32 at the upper end 20 thereof. The lifting mechanism 14 is pivotally affixed at pivot point 34 within the guide 32 and the upper end 20 of the subsea structure 12.

The lifting structure 14 is in the nature of a spreader bar 36 that is pivotally attached to the upper end 20 of the subsea structure 12 at the pivot point 32. The spreader bar 36 will extend on opposite sides of the mandrel 38 which extends upwardly from the upper end 20 of the subsea structure 12. A cable 40 can be connected by a shackle, or by other means, to the spreader bar 36. Importantly, a second extension 42 is affixed to the spreader bar 36 and extends outwardly therefrom. The second extension 42 is in the nature of a second arm 44 that extends outwardly of the spreader bar 36 in a direction corresponding to the direction that the first arm 30 extends outwardly from the bottom 22 of the subsea structure 12. As can be seen in FIG. 1, the first extension 16 will extend in generally transverse relationship to the longitudinal axis of the subsea structure 12. The second extension 42 will extend in generally transverse relationship to a longitudinal axis of the spreader bar 36.

As can be seen in FIG. 1, the inclination apparatus 10 includes a line 36 that has an end connected to a shackle 48 which is, in turn, connected by a pin 50 affixed within the second arm 44 of the second extension 42. Another shackle 52 is connected to the opposite end of the line 46 and is also connected to the inclination tool 54. Inclination tool 54 includes a ratchet rod 56 having a yoke 58 affixed to one end thereof. A body 60 ofthe inclination tool 54 will include a main cylinder 62 which serves to slidably receive the ratchet rod 56 therein. The end of the main body 60 is pivotally affixed by a pin 64 to the end of the first arm 30 opposite the lower end 22 of the subsea structure 12. A hot stab 66 is formed on the body 60 of the inclination tool 54 so as to allow an ROV to control the movement of the ratchet rod 56 in relationship to the cylinder 62. As will be described hereinafter, the inclination tool 54 will include a suitable hydraulic actuator which can serve to move the ratchet rod 56 outwardly of the cylinder 62 or inwardly into the cylinder 62.

In FIG. 1, it can be seen that the inclination tool 54 has been suitably actuated so that the ratchet rod 56 has been drawn inwardly into the cylinder 62 for a suitable distance. This exerts a force on the line 46 and upon the first arm 30 so as to draw the bottom 26 of the subsea structure 12 into an angle $\alpha$. Simultaneously, the opposite end of the line 46 will exert a force on the second arm 44 which serves to pivot the spreader bar 36 about the pivot point 34 on the upper end 20 of the subsea structure 12. As such, an angle $\beta$ is established between longitudinal axis of the spreader bar 36 and the longitudinal axis of the subsea structure 12. This coordinated movement serves to establish a relatively significant degree of angular deflection of the bottom 26 to a relatively minor movement of the ratchet rod 56 of the inclination tool 54.

In the configuration shown in FIG. 1, the bottom 26 of the subsea structure 12 can in orientation suitable for mating with an angularly-deflected connector of a blowout preventer or a wellhead. Typically, if the angular deflection of the plane of the connector of the blowout preventer or the wellhead is greater than 4°, it will be necessary to deflect the bottom 26 to a greater degree such that a mating between the bottom 26 and the connector of the wellhead or blowout preventer can be achieved. The present invention is able to achieve this inclination by the application of hydraulic pressure through the hot stab 66 of the inclination tool 54. As such, the main cylinder 62 of the inclination tool 54 can be drawn upwardly along the ratchet rod 56 and engage the ratchet rod 56 so that the ratchet rod 56 is fixed in a position such that the bottom 26 achieves its desired orientation. Further manipulation is possible so as to allow for minor additional adjustments of the angular orientation of the bottom 26. The subsea structure 12 can then be lowered for mating with the blowout preventer or the wellhead.

If the mating between the bottom 26 and the wellhead or blowout preventer has been achieved, the pin 50 can be released from the second extension 42 of the lifting structure so as to separate the line 46 from the lifting structure. The pivot point 34 and the connection with the subsea structure 12 can be then be released so that the spreader bar 36 and the cable 40 can be moved to a surface location. Suitable buoyancy devices can be connected to the shackle 48 or the line 46. As such, it is only necessary to release the pin 64 of the inclination tool 54 so as to disengage the inclination tool 54 from its connection with the rear end 32. As such, the inclination tool 54 can be delivered to a surface location. As such, a complete installation of the angularly-inclined subsea structure 12 is thereby concluded.

Figure 2:
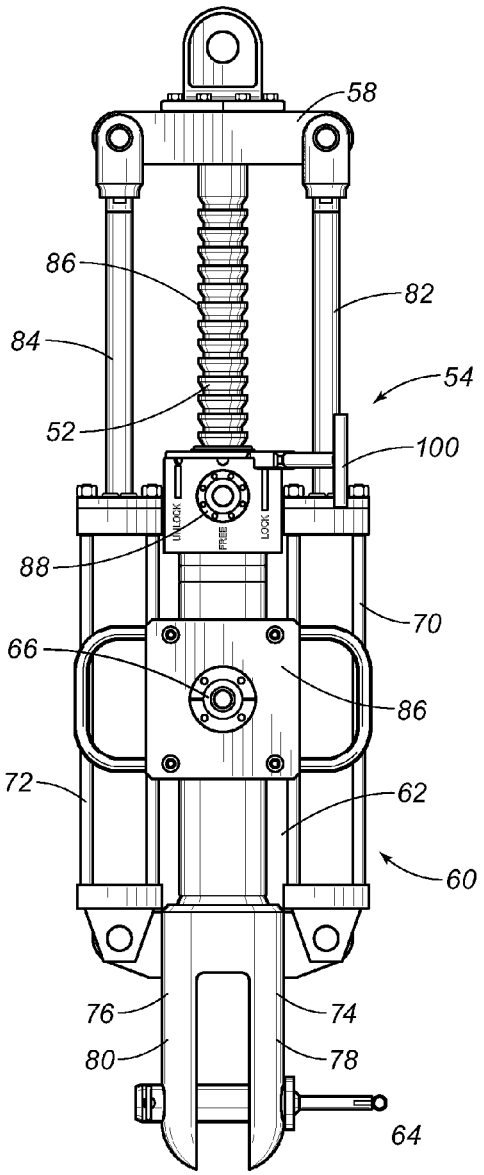
FIG. 2 is a side elevational view of the inclination tool of the present invention in an expanded orientation.

FIG. 2 particularly illustrates the inclination tool 54. In FIG. 2, it can be seen that the inclination tool 54 includes a body 60. The body 60 includes a main cylinder 62 therein. A first hydraulic actuator 70 is positioned on one side of the main cylinder 62. A second hydraulic actuator 72 is positioned on the opposite side of the main cylinder 62. The first hydraulic actuator 70 is in generally parallel relationship with the main cylinder 62. The second hydraulic actuator 72 is also in parallel relationship to the main cylinder 62. A connector 74 is formed at the bottom of the body 60. Connector 74 is in the nature of a clevis having an internal slot 76. Pin 64 will extend between the flanges 78 and 80 of the connector 74 so as to properly engage with the first arm 30 (not shown in FIG. 2). As such, the connector 74 can be securely attachment to the first arm 30 in a pivotal manner.

The first hydraulic actuator 70 acts upon a first piston rod 82. The second hydraulic actuator 72 acts on a second piston rod 84. The hydraulic pressure necessary to operate the piston rods 82 and 84 by the respective actuators 70 and 72 is achieved through the use of the hot stab 66 positioned on the face plate 86 of the main body 60. The yoke 58 is secured to the end of the piston rods 82 and 84 opposite the hydraulic actuators 70 and 72. The yoke 58 includes a suitable shackle 52 that be connected to the end line 46.

Importantly, in FIG. 2, it can be see that the ratchet rod 56 extends from the yoke 58 to the interior of the main cylinder 62. The ratchet rod 56 includes teeth 86 formed on the exterior thereof. Teeth 86 are suitable engaging with a ratchet lock mechanism located within the body 60. A controller 88 is also mounted on the surface of the body 60. Controller 88 includes three settings. These settings include "UNLOCK", "FREE" and "LOCK". The "UNLOCK" position allows the teeth 86 of the ratchet rod 56 to ratchet with respect to ratchet lock mechanism. The "FREE" position will allow for a free movement of the ratchet rod 56 with respect to ratchet lock mechanism. The "LOCK" position fixes a position of the ratchet rod 56 with respect to the main cylinder 62. The ROV can be utilized so as to manipulate the controller 88 between these three positions. As such, control of the movement of the ratchet rod 56 is effectively achieved with the present invention.

Figure 3:
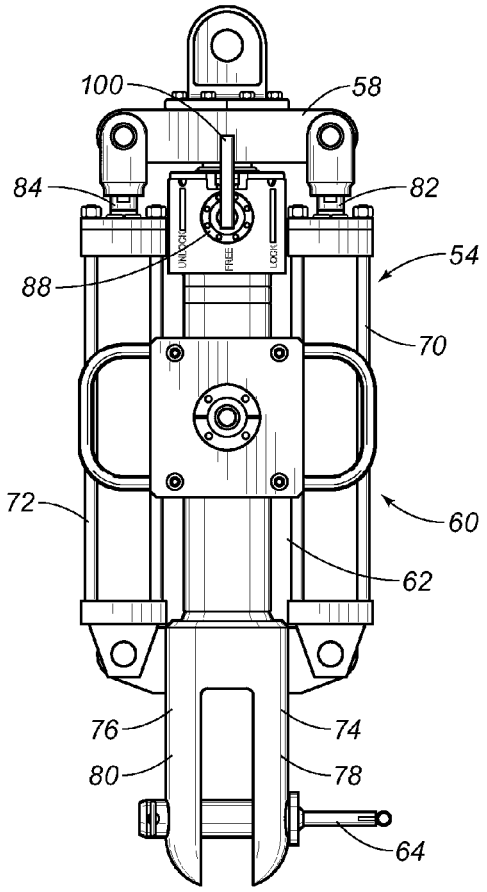
FIG. 3 is a side elevational view of the inclination tool of the present invention in a retracted orientation.

FIG. 3 shows the inclination tool 54 in a fully retracted position. In this position, the yoke 58 resides adjacent to the end of the body 60. As such, the piston rods 82 and 84 have been fully retracted within the hydraulic actuators 70 and 72. The ratchet rod 56 is fully retracted within the main cylinder 62. The controller 88 is illustrated as having a switch arm 100 extending outwardly therefrom. As such, the ROV can grasp the switch arm 100 so as to manipulate the controller 88 between the "UNLOCK" position, the "FREE" position and the "LOCK" position.

The position of the inclination tool 54, as illustrated in FIG. 3, shows the maximum extent of angular movement of the bottom 26 of the subsea structure 12. It is believed that the maximum reasonable angular deflection of the bottom 26 that can be achieved is in the order of 10°.

Figure 4:
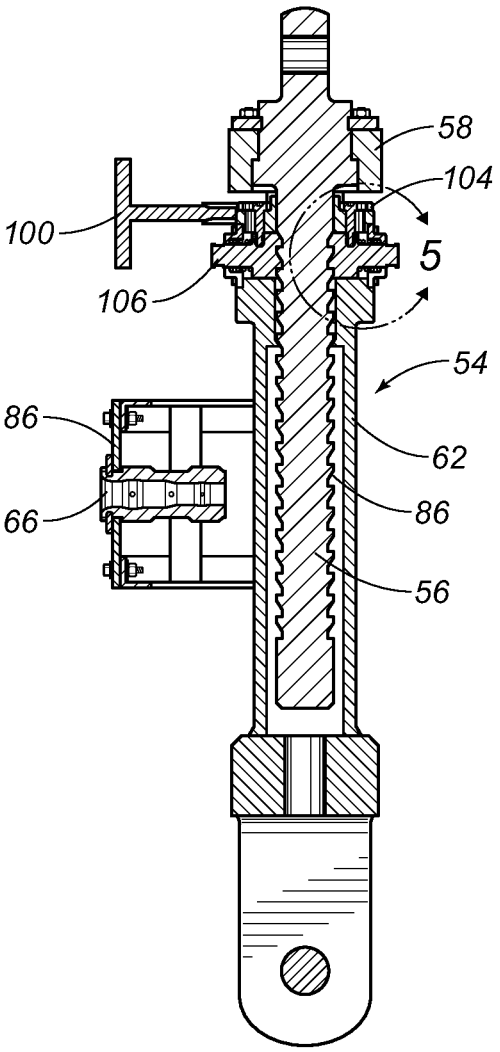
FIG. 4 is a cross-sectional view of the main cylinder of the body of the inclination tool of the present invention.

FIG. 4 shows the interior of the main cylinder 62 of the inclination tool 54 of the present invention. FIG. 4 illustrated the ratchet rod 56 in its fully retracted position. As such, the yoke 58 will be in close proximity to the end 104 of the main cylinder 62.

In FIG. 4, it can be seen that there is a ratchet lock mechanism 106 that has teeth which engage the teeth 86 of the ratchet rod 56. The control switch 100 is cooperative with the ratchet lock mechanism 106 so as to control the movement of the ratchet lock mechanism 106. The hot stab 66 is illustrated as mounted on face plate 86. Hot stab 66 allows hydraulic pressure to be introduced from an ROV into the hydraulic actuators 70 and 72.

Figure 5:
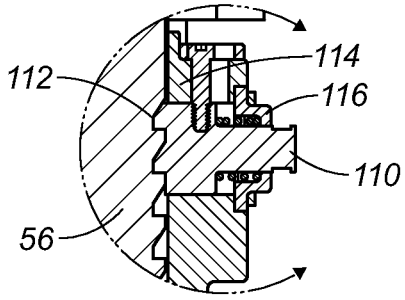
FIG. 5 is a detailed view of the ratchet lock mechanism as shown in circled area "5" of FIG. 4.

FIG. 5 particularly illustrated the ratchet lock mechanism in circled area 5 of FIG. 4. As such, it can be seen the ratchet lock 110 has teeth 112 which engage the teeth 86 of the ratchet rod 56. In FIG. 5, it can also be seen that the control switch 100 includes a cam 114 which can be rotated so as to engage a slot formed on the ratchet lock 110. In this position, as shown in FIG. 5, the teeth 112 of the ratchet lock 110 are fixedly engaged with the teeth of ratchet rod 56. As such, the ratchet rod 56 will be fixed in position and will be incapable of movement upwardly or downwardly. A spring 116 urges on the ratchet lock 110 so as to compress the ratchet lock 110 toward the ratchet rod 56. As such, when the cam 114 is rotated so that it is free of the slot of the ratchet lock 110, the spring will urge the ratchet lock 110 toward the teeth of the ratchet rod 56 so as to allow for a proper ratcheting effect. As such, the ratchet rod can be incrementally adjusted through the operation of the hydraulic actuators. A further movement of the cam 114 will free the ratchet lock 110 so that there is no engagement between the teeth 112 of the ratchet lock 110 and the teeth of the ratchet rod 56. As such, a free movement between the main cylinder 62 and the ratchet rod 56 can be achieved.

Figure 6:
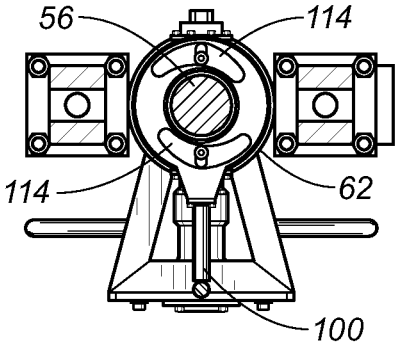
FIG. 6 is a cross-sectional view showing the controller of the ratchet lock mechanism of the present invention.

FIG. 6 further illustrates the configuration of the ratchet rod 56 as positioned within the main cylinder 62. The cam mechanism 114 is particularly illustrated. As such, the rotation of the control switch 100 can suitably manipulate the cams 114 so as to achieve either a locked position, a ratcheting position or a free position.

The foregoing disclosure and description of the invention is illustrative and explanatory thereof. Various changes in the details of the illustrated construction can be made within the scope of the present invention without departing from the true spirit of the invention. The present invention should only be limited by the following claims and their legal equivalents.

I claim:

1. An inclination apparatus comprising:

a subsea structure having an upper end and a lower end;

a lifting structure affixed adjacent to said upper end of said subsea structure and extending upwardly therefrom;

a first extension extending outwardly adjacent to a lower end of said subsea structure;

an inclining mechanism cooperative with said first extension so as to move said first extension and said lower end of said subsea structure in an angular direction offset from horizontal, the lifting structure comprising:

a spreader bar having a lower end pivotally affixed to said upper end of said subsea structure; and a cable affixed to said spreader bar and extending upwardly therefrom.

2. The inclination apparatus of claim 1, said subsea structure being a capping stack, said lower end having a connector suitable for attachment to a blowout preventer or to a wellhead.

3. The inclination apparatus of claim 1, said spreader bar having a second extension extending outwardly therefrom in a direction corresponding to a direction that said first extension extends outwardly from said subsea structure.

4. The inclination apparatus of claim 3, said first extension being a first arm extending outwardly of said subsea structure, said second extension being a second arm extending outwardly from said spreader bar.

5. The inclination apparatus of claim 4, said inclining mechanism comprising:

a line having one end affixed to said second arm and extending outwardly and downwardly therefrom; and an inclination tool having one end connected or interconnected to said first arm, said inclination tool having an opposite end affixed to and cooperative with said line.

6. An inclination apparatus comprising:

a subsea structure having an upper end and a lower end;

a lifting structure affixed adjacent to said upper end of said subsea structure and extending upwardly therefrom;

a first extension extending outwardly adjacent to a lower end of said subsea structure;

an inclining mechanism cooperative with said first extension so as to move said first extension and said lower end of said subsea structure in an angular direction offset from horizontal, said inclining mechanism comprising:

a line having one end attached to one of said lifting structure and said lower end of said subsea structure; and an inclination tool cooperative with said line and connected to the other of said lifting structure and to said lower end of said subsea structure.

7. The inclination apparatus of claim 6, said inclination tool comprising:

a body having a first connector at one end thereof connected to said line and a second connector at an opposite end thereof connected to said other of said lifting structure and lower end of said subsea structure.

8. The inclination apparatus of claim 7, said body comprising:

a main cylinder having an interior, a said main cylinder connected or interconnected to said other of said lifting structure and said lower end of said main body;

a ratchet rod slidably received in said main cylinder, said ratchet rod having a teeth formed thereon; and a ratchet lock mechanism cooperative with said teeth of said ratchet rod so as to selecting allow said ratchet rod to slide in said main body.

9. The inclination apparatus of claim 8, further comprising:

a hydraulic actuator affixed to said main body; and a yoke affixed to said ratchet rod and to said hydraulic actuator, said yoke being connected to said line, said hydraulic actuator suitable for moving said yoke toward or away from said main body.

10. The inclination apparatus of claim 9, further comprising:

a controller affixed to said main body, said controller cooperative with said ratchet lock mechanism so as to allow one of a free movement of said ratchet rod with said main body and a ratcheting movement of said ratchet rod in said main cylinder and a locked position in which said ratchet rod is fixed in relation to said main cylinder.

11. An inclination tool for adjusting an angular orientation of a subsea structure, the inclination tool comprising:

a body having a main cylinder, said body having one end suitable for connection to the subsea structure;

a yoke suitable for connection to a lifting mechanism associated with the subsea structure;

a ratchet rod extending into said main cylinder, said ratchet rod having teeth formed thereof, said ratchet rod having an end affixed to said yoke;

a ratchet lock mechanism affixed to said main body and selectively engageable with said teeth and said ratchet rod so as to fix a position of said ratchet rod in said main cylinder; and a hydraulic actuator affixed to said main body and to said yoke, said hydraulic actuator suitable for moving said yoke relating to said body.

12. The inclination tool of claim 11, said hydraulic actuator comprising:

a first hydraulic actuator positioned in parallel relation to and on one side of said main cylinder; and a second hydraulic actuator positioned in parallel relation to and an opposite side of said main cylinder.

13. The inclination tool of claim 11, further comprising:

a controller affixed to said main body and cooperative with said ratchet lock mechanism so as to allow one of a free movement of said ratchet rod in said main cylinder and a ratcheting movement of said ratchet rod in said main cylinder and a locked position in which said ratchet rod is fixed in position in relation to said main cylinder.

14. The inclination tool of claim 11, further comprising:

a hot stab affixed to said main body and cooperative with said hydraulic actuator, said hot stab suitable for allowing an remotely-operated vehicle (ROV) to selectively control a movement of said hydraulic actuator.

15. A process for causing an inclination of a subsea structure, the subsea structure having an upper end and lower end, the process comprising:

affixing a lifting mechanism in pivotal relationship to the upper end of the subsea structure;

affixing a line to the lifting mechanism, the line extending angularly outwardly and downwardly from the lifting mechanism;

attaching an inclination tool adjacent the lower end of the subsea structure such that said inclination tool is cooperative with said line;

applying a force by the inclination tool to said line so as to cause the upper end of the subsea structure to pivot in relation to said lifting mechanism and to cause a bottom of the subsea structure to because angularly offset from horizontal; and connecting said bottom of the subsea structure to either a connector of a blowout preventer or a wellhead after the bottom is set in a desired angular orientation offset from horizontal.

16. The process of claim 15, said inclination tool having a yoke affixed to said line, said inclination tool having a body with a main cylinder therein, said yoke affixed to a ratchet rod received in said main cylinder, the process further comprising:

ratcheting said ratchet rod within said main cylinder so as to fix a distance between said yoke and said body; and locking said ratchet rod in a fixed position in relation to said main cylinder so as to fix an angular orientation of said bottom of the subsea structure.

17. The process of claim 16, the inclination tool having a hydraulic actuator extending between said yoke and said main body, the process further comprising:

actuating said hydraulic actuator so as to said draw said yoke toward said main body; and ratcheting said ratchet rod in relation to said main cylinder as said yoke is drawn toward said body.

18. The process of claim 15, further comprising:

releasing said line from said lifting mechanism and releasing said inclination tool from the lower end of the subsea structure after the bottom of the subsea structure is connected to the blowout preventer or to the wellhead.

* * * * *